US009528515B2

(12) United States Patent
Heinen et al.

(10) Patent No.: US 9,528,515 B2
(45) Date of Patent: Dec. 27, 2016

(54) GEAR PUMP WITH IMPROVED PUMP INLET

(71) Applicant: MAAG PUMP SYSTEMS AG, Oberglatt (CH)

(72) Inventors: Michael Heinen, Embrach (CH); René Triebe, Schwerzenbach (CH)

(73) Assignee: MAAG PUMP SYSTEMS AG, Oberglatt (CH)

( * ) Notice: Subject to any disclaimer, the term of this patent is extended or adjusted under 35 U.S.C. 154(b) by 0 days.

(21) Appl. No.: 15/026,302

(22) PCT Filed: Oct. 1, 2013

(86) PCT No.: PCT/EP2013/070394

§ 371 (c)(1),
(2) Date: Mar. 31, 2016

(87) PCT Pub. No.: WO2015/048984

PCT Pub. Date: Apr. 9, 2015

(65) Prior Publication Data

US 2016/0238005 A1 Aug. 18, 2016

(51) Int. Cl.

| | |
|---|---|
| ***F04C 15/06*** | (2006.01) |
| ***F04C 13/00*** | (2006.01) |
| ***F04C 2/18*** | (2006.01) |
| ***F04C 2/08*** | (2006.01) |

(52) U.S. Cl.

CPC ..... *F04C 15/06* (2013.01); *F04C 2/18* (2013.01); *F04C 13/002* (2013.01); *F04C 2/084* (2013.01); *F04C 2210/44* (2013.01); *F04C 2240/20* (2013.01); *F04C 2240/50* (2013.01); *F04C 2250/101* (2013.01); *F04C 2250/20* (2013.01)

(58) Field of Classification Search

CPC . F04C 15/06; F04C 2250/101; F04C 2240/50; F04C 2/084; F04C 2/18

See application file for complete search history.

(56) References Cited

U.S. PATENT DOCUMENTS

| | | | | |
|---|---|---|---|---|
| 2,531,726 | A * | 11/1950 | Durdin | F04C 15/06 138/44 |
| 3,376,823 | A * | 4/1968 | Grosjean | F04C 2/14 415/60 |
| 3,746,481 | A * | 7/1973 | Schippers | F04C 15/062 418/206.3 |
| 3,837,768 | A * | 9/1974 | Haupt | F04C 13/002 418/206.5 |

(Continued)

FOREIGN PATENT DOCUMENTS

| | | |
|---|---|---|
| EP | 1790854 A1 | 5/2007 |
| GB | 769895 A | 3/1957 |

*Primary Examiner* — Mary A Davis
(74) *Attorney, Agent, or Firm* — Lucas & Mercanti, LLP

(57) ABSTRACT

Gear pump with meshing gears enclosed by a pump housing, with bearing journals arranged on longitudinal axes and each projecting laterally away from the gears, wherein at least one of the bearing journals has, at least over part of its axial extension, a bearing journal diameter that lies in the range of 90% to 100% of a root diameter of the toothing of the associated gear. A toothing width (b) is at least twice the dimension of a distance (a) between the longitudinal axes, the toothing width (b) being an extension of the gears parallel to the longitudinal axes.

14 Claims, 4 Drawing Sheets

(56) References Cited

U.S. PATENT DOCUMENTS

| | | | | | |
|---|---|---|---|---|---|
| 4,137,023 | A | * | 1/1979 | Moked | F04C 15/06 366/102 |
| 5,388,974 | A | * | 2/1995 | Streiff | F04C 15/06 418/206.4 |

* cited by examiner

GEAR PUMP WITH IMPROVED PUMP INLET

CROSS-REFERENCE TO RELATED APPLICATIONS

The present application is a 371 of International application PCT/EP2013/070394, filed Oct. 1, 2013, the priority of this applications is hereby claimed and this application is incorporated herein by reference.

BACKGROUND OF THE INVENTION

The present invention relates to a gear pump and a use of the gear pump.

Gear pumps mainly consist of a pair of meshing gears, which are enclosed by a housing and from which bearing journals that are arranged around the longitudinal axis project laterally away, which bearing journals are seated in plain bearings being lubricated by conveyed medium.

Since gear pumps have a pressure insensitive conveying characteristic, they are particularly suitable for the transport of conveyed media from a suction side to a pressure side. Between the latter two a pressure gradient is established due to the conveyed volume current in the downstream aggregates, which pressure gradient is particularly large for highly viscous media, and which leads to a transmission of force onto each gear. Since this transmission of force results in a load on the bearing formed by bearing journals and plain bearings, the maximum applicable pressure gradient is limited by the bearing load rating of this bearing, whereby the bearing load rating depends on the strength of the bearing journals and particularly on the diameter of the bearing journals.

A gear pump with maximum bearing load rating is known from EP-1 790 854 A1 of the same applicant. In this known gear pump the bearing journals have at least over a part of their axial extension a bearing journal diameter that lies in the range of 90% to 100% of a root circle diameter of the toothing of the associated gear.

SUMMARY OF THE INVENTION

It is an object of the present invention to further improve the known gear pump particularly with respect to its filling behavior.

Thus, the present invention firstly relates to a gear pump with meshing gears enclosed by a pump housing, with bearing journals arranged on longitudinal axes, each projecting laterally away from the gears, whereby at least one of the bearing journals has, at least over a part of its axial extension, a bearing journal diameter that lies in the range of 90% to 100% of a root circle diameter of the toothing of the associated gear. The gear pump according to the invention is characterized in that a toothing width b is at least twice the size as an axis distance of the longitudinal axes, whereby the toothing width b is an extension of the gears parallel to the longitudinal axes. An embodiment of the gear pump according to the invention consists in that the toothing width b corresponds at most to the double axis distance a plus a six-fold of a tooth height h of the gears.

Further embodiments of the gear pump according to the invention consist in that the toothing width b lies in a range, whose lower limit corresponds to the double axis distance a and whose upper limit corresponds to the double axis distance a plus twice a tooth height h of the gears.

Further embodiments of the gear pump according to the invention consist in that the toothing width b lies in a range, whose lower limit corresponds to the double axis distance a plus twice the tooth height h of the gears and whose upper limit corresponds to twice the distance a between the axes plus the four-fold tooth height h of the gears.

Further embodiments of the gear pump according to the invention consist in that the toothing width b corresponds to the double axis distance a plus a triple tooth height h of the gears.

Even further embodiments of the gear pump according to the invention consist in that on the suction side a transition region with a wall is provided, which wall leads, seen in conveying direction, from a circular inlet cross-section to a pump inlet on an upper toothing plane, whereby the transition region has an extension H in conveying direction of the pumping medium, whereby the extension H is defined as follows:

$$H = \frac{b}{2} \cdot \frac{\sqrt{2} - 1}{\tan \alpha}$$

whereby $\alpha$ is a maximum opening angle of the wall in the transition region and is defined as maximum angle between the conveying direction of pumping medium and a connecting line, which is given by the connection from a starting point to an end point of the wall.

Further embodiments of the gear pump according to the invention consist in that the maximum opening angle $\alpha$ lies in the range from 20° to 50°, preferably is equal to 40°.

Further embodiments of the gear pump according to the invention consist in that a pump inlet on the upper toothing plane is rectangular.

Further embodiments of the gear pump according to the invention consist in that a pump inlet on the upper toothing plane is quadratic.

Further embodiments of the gear pump according to the invention consist in that a wall in the transition region runs in straight lines in all cutting planes passing across a central axis.

Further embodiments of the gear pump according to the invention consist in that a wall in the transition region runs piecewise in straight lines in predetermined cutting planes passing across a central axis.

Further embodiments of the gear pump according to the invention consist in that a wall in the transition region runs piecewise continuous and/or piecewise in straight lines in predetermined cutting planes passing across a central axis.

Further embodiments of the gear pump according to the invention consist in that tangents running in cutting planes enclose a maximum angle of ±10° with the respective opening angle $\alpha$.

Finally, the present invention refers to a use of the gear pump according to one or several of the above-mentioned embodiments for conveying a highly viscous polymer melt.

BRIEF DESCRIPTION OF THE DRAWINGS

In the following the present invention is further explained as mere examples by drawings. It is shown in.

DETAILED DESCRIPTION OF THE PREFERRED EMBODIMENTS

Figure 1:
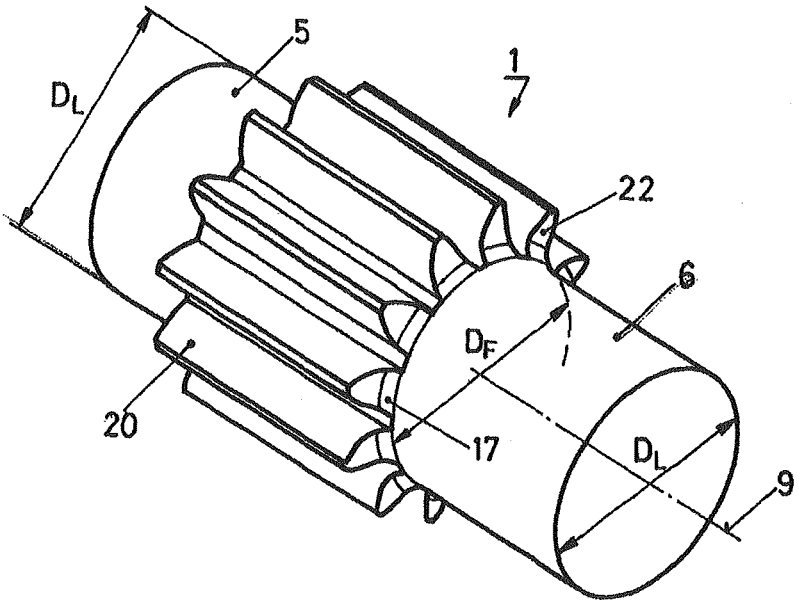
FIG. 1 a known gear with bearing journals, in perspective view.

FIG. 1 shows a gear 1 for a gear pump with teeth 20 and bearing journals 5 and 6, whereby neither a second gear with the respective bearing journals nor the stationary components of the gear pump—as housing, plain bearing, drive etc.—are pictured for the sake of simplicity. The bearing journals 5 and 6 have—at least over a part of their axial extension—a bearing journal diameter $D_L$ that lies in the range of 90% to 100% of a root circle diameter $D_F$ of the gear 1. This also applies to the bearing journals of the second gear not shown in FIG. 1, of course.

The teeth 20 of gear 1 have front faces of the teeth 22, of which only the front faces of teeth 22 facing toward the bearing journal 6 are visible in FIG. 1 and which show stress-optimised transitions 17 for attenuation of stresses arising due to notch effect. The stress-optimised transitions 17 consist, for example, in one or several tangentially converging radii that extend to the surface of the bearing journal 6.

In the example shown in FIG. 1 the bearing journal diameter $D_L$ is approximately as large as the root circle diameter $D_F$.

Figure 2:
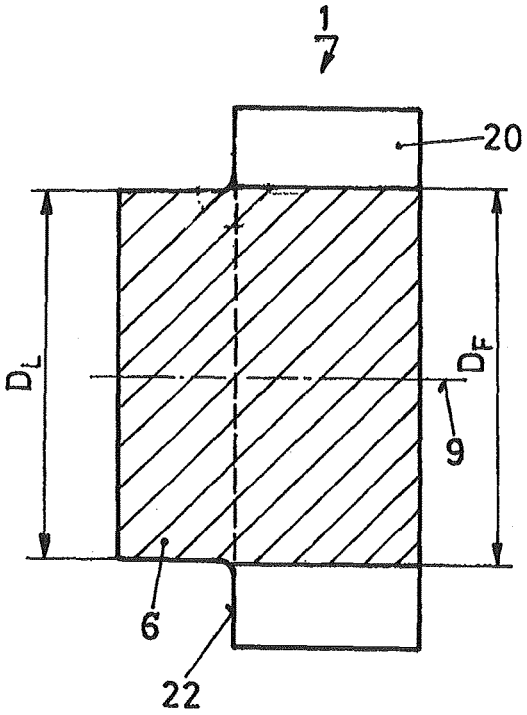
FIG. 2 a cross section across the longitudinal axis of the arrangement according to FIG. 1, FIG. 3 a gear pump according to the invention in top view and a cross section perpendicular to the longitudinal axes of the gear pump, FIG. 4 a further embodiment of a wall in the transition region between inlet and gear level shown in detail in a cross section according to FIG. 3, lower part.

FIG. 2 shows a cross-section through tooth spaces of the gear 1 and through a longitudinal axis 9 of the bearing journal 5, 6 or the gear 1, respectively. It is clearly apparent that the bearing journal diameter $D_L$ corresponds approximately to the root circle diameter $D_F$, such that basically only the front faces of teeth 22 lay open on the face of the gear 1 facing the bearing journal 6.

Figure 3:
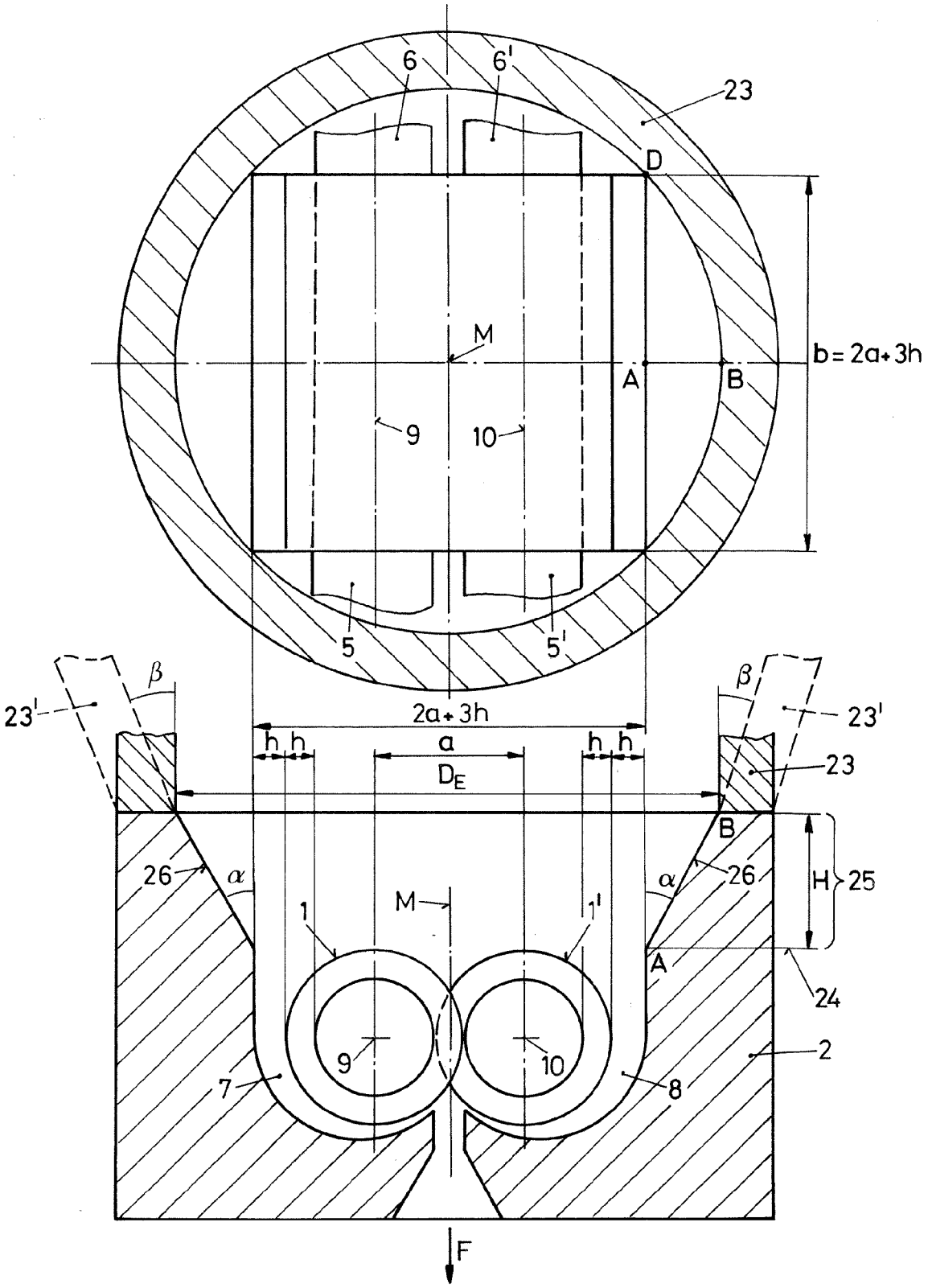

FIG. 3 shows a pump inlet on the suction side in a top view (upper half of FIG. 3) and a cross-section through the gear pump perpendicular to the longitudinal axes 9 and 10 (lower half of FIG. 3).

In the cross-section (lower half of FIG. 3) both the gears 1 and 1', a pump housing 2, which receives the gears 1, 1' and the journals 5, 6 (FIG. 1), and an inlet 23 are visible. The inlet 23 may have the form of a tube, which leads to the reactor vessel, or may be the reactor vessel itself, which shows, for example conically running walls. In FIG. 3 such an inlet 23' running conically under an inlet angle β is indicated by dashed line. The height of the pump inlet is denoted with H, which corresponds to the distance from a plane just above the toothing of the gears 1, 1' (hereinafter referred to as upper toothing plane 24) and the lower end of the inlet 23. This pump inlet is a transition region 25 belonging to the gear pump or their housing, respectively, with a wall 26 from a circular cross-section of the inlet 23 to a rectangular cross-section of the upper toothing plane 24. In the cross-section shown in the lower half of FIG. 3 the wall 26 of the transition region 25 is further characterized by a point A, which lies on the toothing plane 24, and a point B, which marks the upper end of the wall 26.

Fundamentally, it is conceivable in further embodiments of the present invention that the cross-section of the inlet 23 deviates from a circular cross-section and/or that the cross-section on the upper toothing plane 24 deviates from a rectangular cross-section.

The transition region 25—and therewith the wall 26—shows, again with regard to the embodiment according to FIG. 3, starting from the rectangular cross-section of the upper toothing level 24 (i.e., from point A), a maximum opening angle α, on which the height H depends, whereby the height H increases, if one reduces the opening angle α. Thereby, the opening angle α corresponds to the angle that lies between the central axis M and the connection of the points A and B.

With a use of the gear pump for pumping highly viscous polymer melts from a reactor, it is of greatest importance that an inlet pressure loss as low as possible—also named NPSH—is achieved. This is achieved, when the mentioned transition region 25 or the wall 26 between the upper toothing plane 24 and the end region of the inlet 23, respectively, is formed as simple and regular as possible. In particular, the as simple and regular as possible transition should be made without further transitions and edges from the circular reactor cross-section or the circular inlet 23, respectively, to the rectangular cross-section directly above the toothing (i.e. the upper toothing plane 24).

If the cross-section of the pump inlet in the upper toothing plane 24 is selected to be as square as possible, preferably square, the condition of an advantageous transition from a circular reactor cross section or the circular inlet 23, respectively, to the rectangular cross-section on the upper toothing plane 24 is fulfilled at the best possible.

It has become evident that a first embodiment of the gear pump according to the invention is achieved then, when the toothing width b is at least twice the dimension of the distance a of the axes 9 and 10, whereby the toothing width b is an extension of the gears 1, 1' parallel to the axes 9 and 10.

On the other hand, in a further embodiment, the toothing width b is limited by a maximum that results from twice the distance a of the axis plus a sixfold of a tooth height h of the gears 1, 1'.

Further embodiments I, II and III result from the following specification for ranges, in which the toothing width b lies, namely:

Embodiment I $$2\cdot a \leq b \leq 2\cdot a + 2\cdot h$$

Embodiment II $$2\cdot a + 2h \leq b \leq 2\cdot a + 4\cdot h$$

Embodiment III $$b = 2\cdot a + 3\cdot h$$

The embodiment III is shown in FIG. 3, whereby the inlet cross-section in the upper toothing plane 24 then corresponds exactly to a square, if its corners lie on the alignment of the inner diameter $D_E$ of the inlet 23.

If now, as proposed in a further embodiment of the present invention, the maximum opening angle α is selected to be in the range from 20° to 50°, in particular equal 40°, the height H of the transition region is reduced as a function of the maximum opening angle α and the toothing width b as follows:

$$H = \frac{b}{2} \cdot \frac{\sqrt{2} - 1}{\tan \alpha}$$

This means that, for constant maximum opening angle α, the height H of the transition region is directly proportional to the toothing width b. For an embodiment of the present invention according to the preceding explanations regarding the height H, not only an extremely low insert pressure loss (NPSH) is obtained, but a short transition region 25 is obtained as well, whereby the construction height of the complete assembly consisting of gear pump and reactor vessel is optimized to be minimal.

Figure 4:
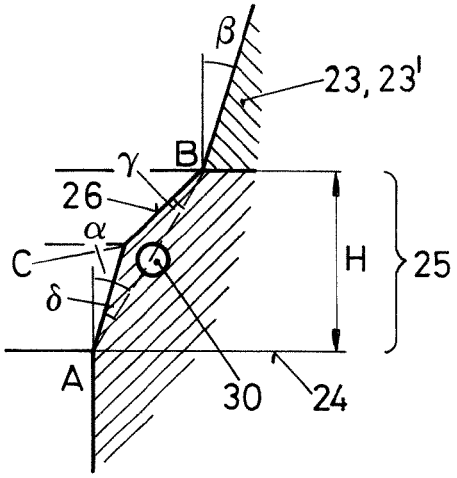

From FIG. 3, below, it is evident that there exists a straight-line connection between the points A and B, as it is provided according to an embodiment of the present invention. In modification of this straight-line course of the wall 26 in the transition region 25, it is conceivable in further embodiments of the present invention that the positions of both the points A and B remain the same as connection points (starting point and end point), whereas the course between these points A and B may run discretionary to a certain degree. For example, in further embodiments it is provided that the course of the wall 26 between the points A and B only occurs piecewise in straight line. FIG. 4 shows a possible embodiment, for which the connection between the points A and B again is defined by the opening angle α, but the actual course of the wall 26 passes via a point C, which lies in between the points A and B. The actual course of the wall 26 deviates in point A by an angle δ from the connecting line between the points A and B, and deviates in point B by an angle γ from the connecting line between the points B and A. This results in a piecewise straight-line course of the wall 26 via the point C.

Both the angles γ and δ may lie within an angular range of ±10°, preferably within an angular range of ±5°, whereby it is not necessary, that both angles γ and δ are of equal size. Rather the individual values of the angles γ and δ are selected such that the point C is located at suitable position.

Figure 5:
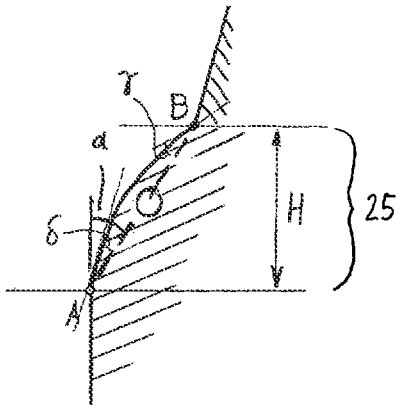
FIG. 5 is a further embodiment of a wall in the transition region between inlet and gear level.

In principle, however, it is not necessary either that the connection between points A and B—and therewith the wall 26—run in straight line. As shown in FIG. 5, a continuously curved line between the points A and B or a piecewise continuously curved line in combination with piecewise straight line sections, whereby a tangent in an arbitrary point of the curved line shall likewise fulfill the precedingly mentioned criteria concerning the angular size γ and δ between the tangent and the straight connecting line between the points A and B, is also rather conceivable.

A possible reason for a deviation from a straight-line connection between the points A and B is, for example, a heating bore 30 (FIG. 4) for the liquid temperature control in the inlet 23.

As is evident from FIG. 3, upper part, the angle α is largest in the shown cutting plane (FIG. 3, lower part) and in a cutting plane perpendicular to this cutting plane for the same embodiment. If one regards a cutting plane that deviates from the mentioned cutting plane (the one shown in FIG. 3, upper part, and the cutting plane running perpendicular to this cutting plane), the opening angle α is smaller in such deviating cutting planes. Is the cutting plane laid through point D, the opening angle α is equal zero. For this reason, the opening angle α always refers to a maximum angle, which occurs in a certain embodiment in the in the cutting plane shown in FIG. 3—or perpendicular to this cutting plane.

The invention claimed is:

1. A gear pump, comprising:

a pump housing;

meshing gears enclosed by the pump housing, the meshing gears each having a toothing, the meshing gears configured to pump a pumping medium in a conveying direction through the pump housing; and bearing journals arranged on longitudinal axes, each bearing journal projecting laterally away from one of the gears, wherein at least one of the bearing journals has, at least over a part of an axial extension, a bearing journal diameter ($D_L$) that lies in the range of 90% to 100% of a root circle diameter ($D_F$) of the toothing of a corresponding one of the gears, a toothing width b is at least twice as large as distance a between the longitudinal axes of the gears, the toothing width b being an extension of the gears in a direction parallel to the longitudinal axes, a suction side of the pump housing includes a transition region with a wall that, in the conveying direction, transitions from a circular intake cross-section to a pump inlet on an upper toothing plane, a cross-section of the pump inlet in the upper toothing plane is substantially square, wherein the transition region has an extension H in the conveying direction of the pumping medium, wherein the extension H is defined as follows:

$$H = \frac{b}{2} \cdot \frac{\sqrt{2} - 1}{\tan \alpha}$$

where α is a maximum opening angle of the wall in the transition region and is defined as a maximum angle between the conveying direction of the pumping medium and a connecting line between a starting point (A) of the wall to an end point (B) of the wall.

2. The gear pump of claim 1, wherein the toothing width b is at most 2a+6h, where a is the distance between the longitudinal axes of the gears and h is a tooth height of the gears.

3. The gear pump of claim 1, wherein the toothing width b lies in a range, whose lower limit is 2a and whose upper limit is 2a+2h, where a is the distance between the longitudinal axes of the gears and h is a tooth height of the gears.

4. The gear pump of claim 1, wherein the toothing width b lies in a range, whose lower limit is 2a+2h and whose upper limit is 2a+4h, where a is the distance between the longitudinal axes of the gears and h is a tooth height of the gears.

5. The gear pump of claim 1, wherein the toothing width b is 2a+3h, where a is the distance between the longitudinal axes of the gears and h is a tooth height of the gears.

6. The gear pump of claim 1, wherein the maximum opening angle a lies in the range of 20° to 50°.

7. The gear pump of claim 1, wherein the maximum opening angle α is equal 40°.

8. The gear pump of claim 1, wherein the cross-section of the pump inlet on the upper toothing plane is square.

9. The gear pump of claim 1, wherein the wall in the transition region runs in straight lines in all cutting planes passing across a central axis (M).

10. The gear pump of claim 1, wherein the wall in the transition region runs piecewise in straight lines in predetermined cutting planes passing across a central axis (M).

11. The gear pump of claim 10, wherein each of the straight lines in the cutting planes enclose a maximum angle of ±10° with the respective opening angle α.

12. The gear pump of claim 1, wherein the wall in the transition region runs piecewise continuous in predetermined cutting planes passing across a central axis (M).

13. The gear pump of claim 12, wherein tangents of the piecewise continuous wall running in the cutting planes enclose a maximum angle of ±10° with the respective opening angle α.

14. A method of using the gear pump of claim 1, comprising using the gear pump to convey a highly viscous polymer melt as the pumping medium.

* * * * *